US010167180B2

(12) United States Patent
Kent et al.

(10) Patent No.: US 10,167,180 B2
(45) Date of Patent: Jan. 1, 2019

(54) ADJUSTABLE PALLET FORKS

(71) Applicants: Derek W Kent, Becker, MN (US); Jay Kockler, Sartell, MN (US)

(72) Inventors: Derek W Kent, Becker, MN (US); Jay Kockler, Sartell, MN (US)

( * ) Notice: Subject to any disclaimer, the term of this patent is extended or adjusted under 35 U.S.C. 154(b) by 0 days.

(21) Appl. No.: 15/002,327

(22) Filed: Jan. 20, 2016

(65) Prior Publication Data

US 2016/0207747 A1 Jul. 21, 2016

Related U.S. Application Data

(60) Provisional application No. 62/105,365, filed on Jan. 20, 2015.

(51) Int. Cl.
*B66F 9/14* (2006.01)

(52) U.S. Cl.
CPC ..... *B66F 9/143* (2013.01)

(58) Field of Classification Search
CPC ..... B66F 9/143
USPC ..... 414/667, 439
See application file for complete search history.

(56) References Cited

U.S. PATENT DOCUMENTS 1,813,596 A * 7/1931 Abbe ..... B66F 9/08 414/634
2,468,055 A * 4/1949 Gibler ..... B66F 9/12 108/57.15
2,483,745 A * 10/1949 Vossenberg ..... B66F 9/142 414/671
4,381,166 A * 4/1983 Smart ..... B66F 9/143 414/667
4,688,982 A * 8/1987 Smart ..... B66F 9/065 414/667
7,779,562 B1 * 8/2010 Loveless ..... E02F 3/3627 37/231

* cited by examiner

*Primary Examiner* — Jonathan Snelting
(74) *Attorney, Agent, or Firm* — Gutwein Law; Greg N. Geiser

(57) ABSTRACT

An attachment device having adjustable pallet forks for attachment to a skid steer or other vehicle. The device allows a user to adjust the width of the pallet forks without exiting the skid steer or vehicle. The device includes a wheel in communication with the pallet forks wherein the wheel is aligned to be engaged with a ground surface upon manipulation of the hydraulic controls of the skid steer or vehicle allowing for movement of the wheel to equate to movement of the width of the pallet forks.

1 Claim, 4 Drawing Sheets

ADJUSTABLE PALLET FORKS

CROSS REFERENCE TO RELATED APPLICATIONS

This application claims priority to U.S. Provisional Patent Application No. 62/105,365 filed 20 Jan. 2015 to the above named inventors, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to adjustable pallet forks for attachment to a vehicle.

BACKGROUND OF THE INVENTION

In the course of completing landscaping tasks a user will often use a skid steer or other wheeled vehicle. These skid steers and vehicles utilizes a universal quick attach system or retained pins to allow for the quick and efficient attachment of various implements for use on a jobsite. As a number of materials needed for landscaping often arrive to the jobsite on pallets, pallet forks are a desired attachment to move materials within the jobsite. Often times, the pallets used within a jobsite are of multiple dimensions requiring the pallet forks to be adjusted to varying widths.

On a typical device with pallet forks for use on a skid steer, a user is required to exit the vehicle to either manually adjust the forks to the desired width or exit the vehicle and make suitable hydraulic connections upon the installation of the forks. Upon these manipulations the forks are then positioned to the desired width and the pallet can be picked and moved to the desired location.

Although there exists pallet forks for a skid steer, there exists a need for pallet forks attachable to a skid steer that are easily adjustable without the operator leaving the vehicle. Preferably, these pallet forks are durable and do not require the use of hydraulics.

SUMMARY OF THE INVENTION

The adjustable pallet fork device according to the present invention is designed to allow for the easy manipulation and movement of pallets within a jobsite by being affixed to a skid steer. The device includes a frame to provide structure for the support and attachment of the device features. A universal quick attach or pins for receipt on a vehicle mount are affixed to the frame and located at a first end of the device, the first end proximal to the skid steer attachment point allowing the device to be quickly and easily affixed to the skid steer.

At a second end of the device, distal to the attachment end, the device includes a pair of pallet forks. The pallet forks extending outward and from the device opposite the first end. The pallet forks having a size and a length to receive pallets. The pallet forks are movably affixed to the frame utilizing a means to adjust the distance between each individual pallet fork, wherein the user can manipulate the device to adjust the distance between the pallet forks without leaving the skid steer vehicle.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
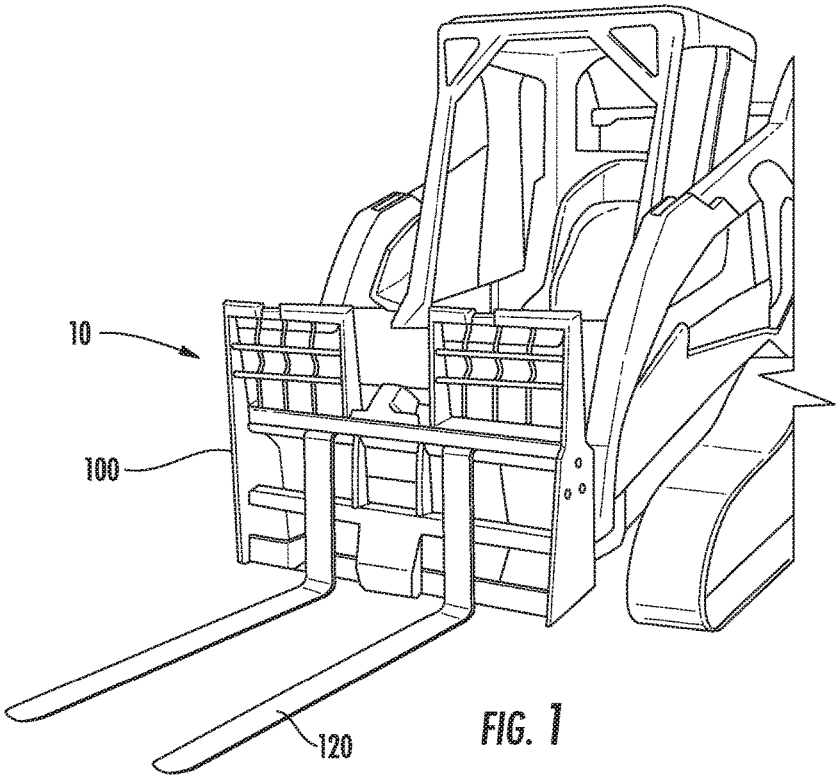
FIG. 1 is an isometric view of the adjustable pallet fork device, according to the present invention.
Figure 2:
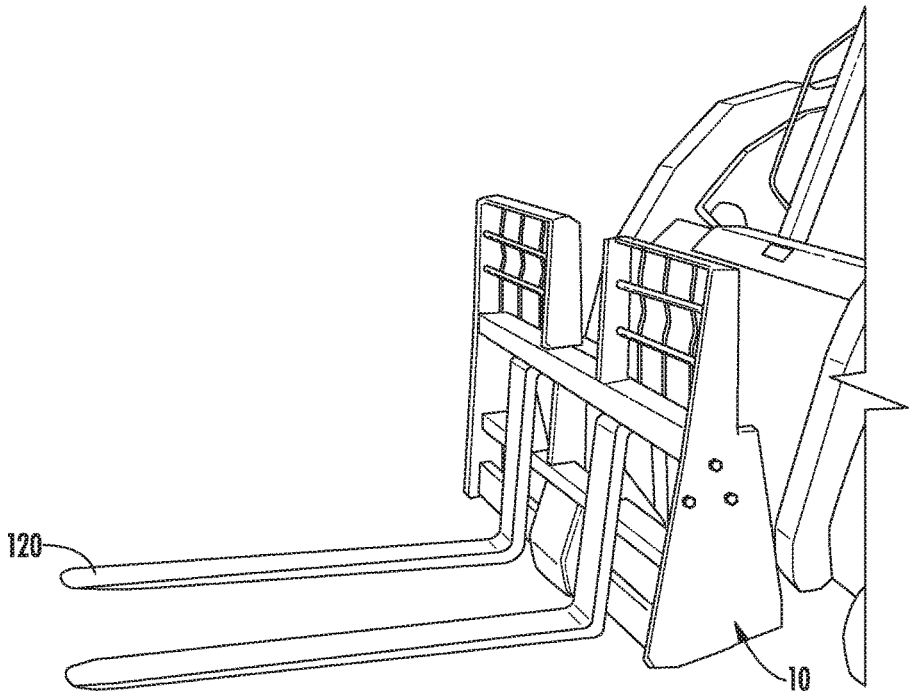
FIG. 2 is a side view of the adjustable pallet fork device, according to the present invention.
Figure 3:
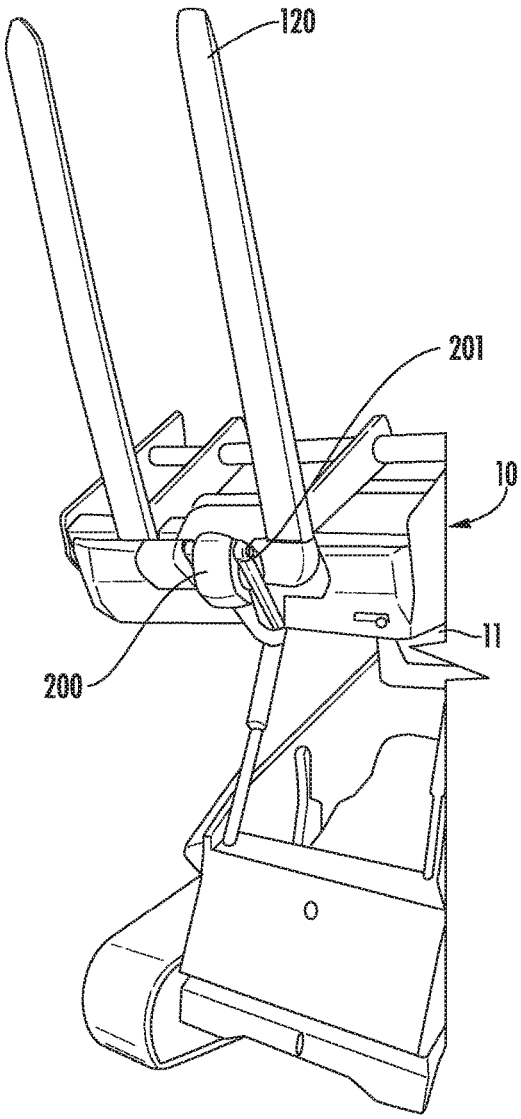
FIG. 3 is a bottom side of the adjustable pallet fork device, according to the present invention.
Figure 4A:
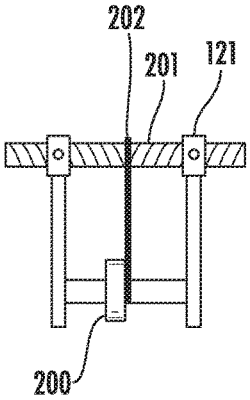
FIG. 4 contains various views of an alternate embodiment of the device having adjustable pallet forks, according to the present invention.
Figure 4B:
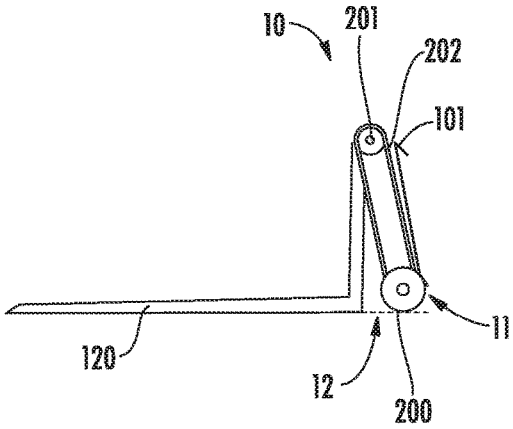
Figure 4C:
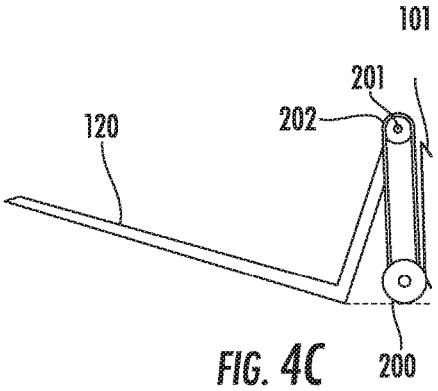

The following detailed description includes references to the accompanying drawing, which forms a part of the detailed description. The drawing shows, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Referring now to FIG. 1 of the attachment device having adjustable pallet forks according to the present invention generally referred to as device 10. The device 10 includes a frame 100 to provide structure for the support and attachment of the device 10 features. A universal quick attach 101 or other attachment mechanism is affixed to the frame and located at a first end 11 of the device 10, the first end 11 proximal to the skid steer or vehicle attachment point allowing the device 10 to be quickly and easily affixed to the skid steer or other vehicle.

A second end 12 of the device 10 is distal to the attachment point 101 and includes a pair of pallet forks 120. The pallet forks 120 extending outward and from the device 10 opposite the first end 11. The pallet forks 120 having a size and a length to receive pallets. The pallet forks 120 are movably affixed to the frame 100 utilizing a means to adjust the distance between each individual pallet fork 120, wherein the user can manipulate the device 10 to adjust the distance between the pallet forks 120 without leaving the skid steer or vehicle.

In the preferred embodiment of the present invention, the means to adjust the distance between the pallet forks 120 includes a wheel 200 and a threaded rod 201 secured within the pallet forks 120. The threaded rod 201 acts as axle for the wheel and includes left hand and right hand threads, wherein movement of the wheel 200 turns the rod 201. Accordingly, the wheel 200 is positioned at a bottom of the device 10 and mounted in an angular configuration, wherein the wheel 200 is not in contact with a ground surface when the pallet forks 120 are leveled with the ground surface, but the wheel 200 can be selectively manipulated to be in contact with the ground surface by angling the pallet forks 120 in an upward position. Therefore, a user of the device 10 is then able to utilize the skid steer or vehicle movement to turn the wheel 200 to adjust the width of the pallet forks 120, wherein movement of the wheel 200 in one direction increases the width between the individual pallet forks 120 and movement of the wheel 200 in the opposite direction decreases the width between the individual pallet forks 120. The wheel 200 is preferably constructed out of a durable and solid material to withstand the conditions of the working environment.

In an alternate embodiment of the present invention, the wheel 200 includes a hub having a toothed gear. The teeth of this gear are intermeshed with a chain 202 in communication with the threaded rod 201. The threaded rod 201 extends a width of the device 10 and is received within a nut 121 affixed to the pallet fork 120 upper end. Accordingly, rotation of the threaded rod 201 will cause movement of the pallet forks 120 and allow the distance of the width between each pallet fork 120 to be adjusted. The threaded rod 201 will include a toothed gear centrally affixed to its length to receive the chain 202 in communication with the wheel 200 and complete the mechanical linkage between the threaded rod 201 and the wheel 200.

In the preferred embodiment of the present invention, the threaded rod 201 is designed to have its travel restricted to prevent excess travel of the pallet forks 120.

Although the preferred mechanical linkage for movement of the pallet forks 120 is a threaded rod 201 as an axle for rotation of the wheel 200, other similar mechanisms are applicable and anticipated. It is preferred that the mechanism utilizes a wheel 200 in removable communication with the ground surface through the selective manipulation of the hydraulic controls of the skid steer or vehicle. Further, it is preferred that the rotation of this wheel 200 be tuned to allow for a small length of travel to correspond to the maximum distance of travel of the pallet forks 120.

In use a user will attach the device 10 to the skid steer or vehicle for use on the job to move objects by engaging the quick attach 101. The user will then contact the wheel 200 to the ground surface and move the wheel 200 forward or backward though movement of the skid steer or vehicle to move the pallet forks 120 to the desired width. The pallet forks 120 and skid steer or vehicle can then be used to move the object to the desired location.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the specification.

What is claimed is:

1. A pallet loading attachment for a vehicle, the pallet loading attachment removably coupled to the vehicle, the attachment comprising:

a frame, the frame having a first end, the first end aligned proximal to the vehicle for attachment, the first end having a universal quick attach, and a second end opposite the first end and distal to the vehicle;

a pair of pallet forks, the pallet forks movably received within the frame and extending outward opposite the first end, the pallet forks sized for receipt within a pallet, the pallet forks each spaced a width, wherein the width defines a distance between each pallet fork;

a wheel, the wheel centrally positioned on a lower side of the frame, the wheel positioned a height above a bottom of the pallet forks, and the wheel positioned in selective communication with a ground surface, wherein the wheel height is above a ground surface when the pallet forks are leveled upon the ground surface and wherein the wheel is contacted with the ground surface when the pallet forks are tilted in an upwards direction opposite the ground surface; and a threaded rod, the threaded rod forming an axle of the wheel and having opposed threads aligned on opposed sides of the wheel, the threaded rod having opposed ends, the opposed ends in communication with each pallet fork, wherein movement of the wheel adjusts the width between each pallet fork.

* * * * *